US005375295A

United States Patent [19]

Woodward

[11] Patent Number: 5,375,295

[45] Date of Patent: Dec. 27, 1994

[54] DOOR KNOB LEVER ATTACHMENT

[76] Inventor: John M. Woodward, 460 Flagstaff, Hoffmen Estates, Ill. 60194

[21] Appl. No.: 10,651

[22] Filed: Jan. 28, 1993

[51] Int. Cl.[5] ..... E05B 7/00

[52] U.S. Cl. ..... 16/114 R

[58] Field of Search ..... 16/114 R; 292/347, DIG. 2

[56] References Cited

U.S. PATENT DOCUMENTS

| | | | |
|---|---|---|---|
| 4,223,931 | 9/1980 | Neary . | |
| 4,397,489 | 8/1983 | Lind . | |
| 4,504,087 | 3/1985 | Pennington . | |
| 4,648,643 | 3/1987 | Bettger . | |
| 4,783,883 | 11/1988 | Szalay . | |
| 4,913,479 | 4/1990 | Allison . | |
| 4,971,375 | 11/1990 | Grecco | 16/114 R |
| 5,219,192 | 6/1993 | Berger | 292/347 |
| 5,231,731 | 8/1993 | Jones, Jr. | 16/121 |

*Primary Examiner*—P. Austin Bradley
*Assistant Examiner*—Chuck Y. Mah
*Attorney, Agent, or Firm*—Polster, Lieder, Woodruff & Lucchesi

[57] ABSTRACT

A lever attachment is securable to a door knob to retrofit the door knob for easier operation by disabled persons. The attachment includes a generally annular body sized to slide over a door knob. The body has a front and a back with respect to its mounted position. A flange extends radially inwardly from the body front and a lever arm extends radially outwardly from the body. The body is frictionally secured to the door knob to fix the attachment rotationally with respect to said door knob so that the door knob may be operated by use of the lever arm. The attachment is non-handed with respect to the door handle position.

2 Claims, 1 Drawing Sheet

DOOR KNOB LEVER ATTACHMENT

BACKGROUND

This invention relates to levers, and in particular, to a lever which may be secured to a door to retrofit the door for easier use by disabled or handicapped persons.

As can be appreciated, the disabled, the handicapped, and those who suffer from diseases such as arthritis may have difficulties operating standard door knobs. Many devices have been designed to retrofit doorknobs so that they may be more easily used by the disabled. However, many of these retrofits are multi-piece attachments which are not easily placed on a door knob. If the function for their intended purpose, they often do not operate over a wide range of door knob configurations. For example, if the prior art attachment works well with barrel knobs, it often will not function as well with oval, round or tulip style knobs.

Further, the recently enacted Americans with Disabilities Act requires employers and owners of public buildings to provide easy access to the disabled. To provide such access through doors which have standard door knobs, such as are used in offices or homes, will require the replacement or retrofitting of the door knob. As will be appreciated, doors and their respective knobs can be installed left or right handed combination and the attachment described hereafter provides simple installation in either configurations.

One object of this invention is to provide an attachment which may be secured to a door knob to retrofit the door knob for use by disabled or handicapped individuals.

Another object is to provide such an attachment which may be easily secured to the door knob.

Another object is to provide such an attachment which may be used on a multitude of door knob styles.

A further object is to provide such an attachment which is economical to produce and simple to assemble.

These and other objects will become apparent to those skilled in the art in light of the following description and accompanying drawings.

SUMMARY OF THE INVENTION

In accordance with the invention, generally stated, a non-handed lever attachment is mountable on a door knob to retrofit the door knob for easier operation by disabled persons. The attachment includes a generally annular body sized to fit over a door knob. The attachment body has a front, a back and at least one side wall. A flange extends radially inwardly from the body front. A lever arm extends radially outwardly from the side wall of the body. The body is frictionally secured to the door knob by means of a set screw to fix the attachment with respect to the door knob so that the door knob may be rotationally operated by use of the lever arm. The lever arm is a separate piece which is attached to the side wall of the body. In the preferred embodiment, the lever arm is attachable to the body in at least two locations, making the device non-handed. The lever arm has a blind bore which fits over a post which is secured to and extends radially outwardly from the body. A guide and corresponding bore are provided between the arm and the body. The lever arm is secured to the post by means of set screws.

DESCRIPTION OF THE PREFERRED EMBODIMENT

Figure 1:
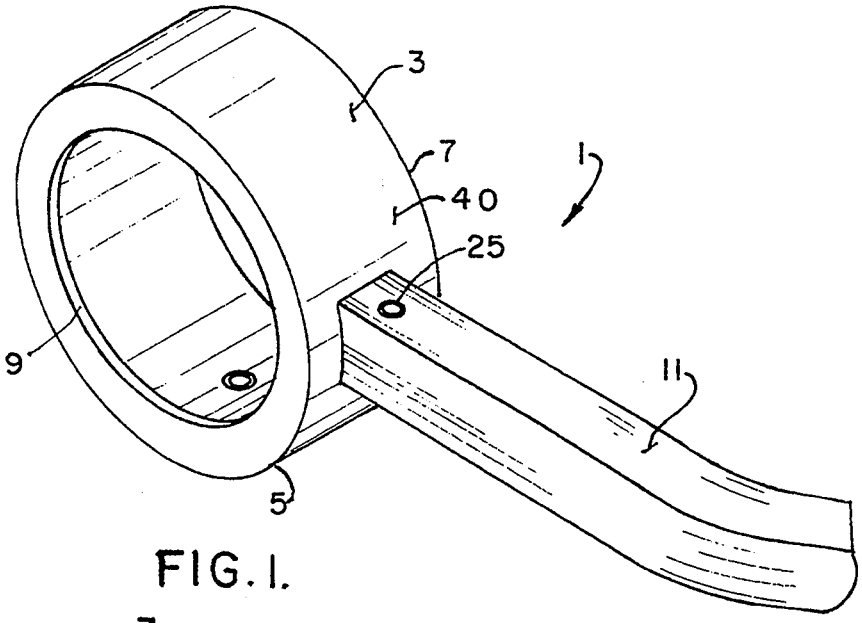
FIG. 1 is a perspective view of an illustrative embodiment of a door knob attachment of the present invention.

Referring to the drawings, a door knob attachment is indicated generally by reference numeral 1. Attachment 1 includes an annular one-piece body 3 having a front 5, a back 7 and a side wall 40. A flange 9 extends radially inwardly from front 5 and a lever arm 11 extends radially outwardly from body 3 from the side wall 40. Lever arm 11 includes a front 13 which is adjacent the body 3. Preferably lever arm front 13 is shaped to accommodate the curvature of body 3.

Body 3 defines two threaded holes openings 15 and 17 and two bores 41 and 42. An elongate post or screw 19 is threadably received in hole 15. As indicated below, post 19 is removably mounted in hole 15. Lever arm 11 includes a bore 21 extending inwardly from its front 13. A through bore 23 also is formed in arm 11. The bore 23 is transverse to and intersects bore 21. Post 19 is received in bore 21 and set screws 25 are received in opposite sides of bore 23 to hold lever 11 to post 19. While two sets screws 25, as shown, preferably are used to secure lever arm 11 in place, one set screw may be used in other embodiments of my invention. Bore 21 preferably is threaded to hold arm 11 more securely to post 19.

Figure 2:
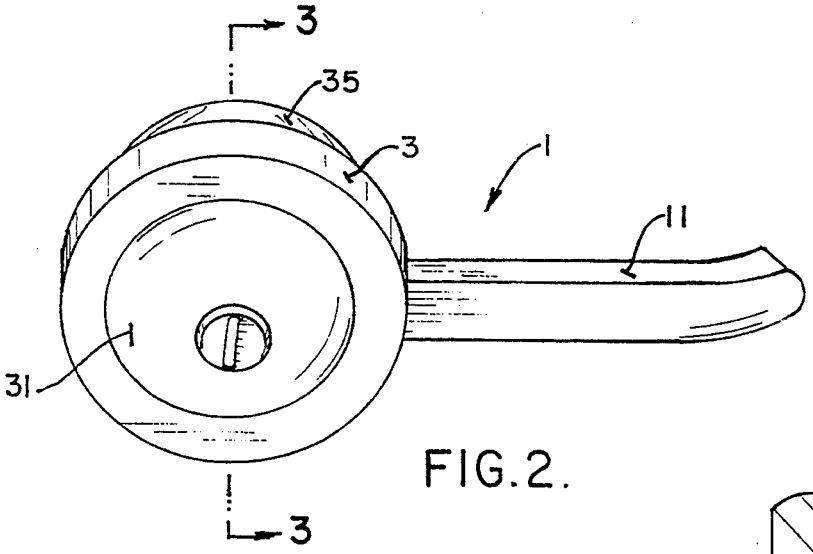
FIG. 2 is a perspective view of the attachment secured to a door knob.
Figure 3:
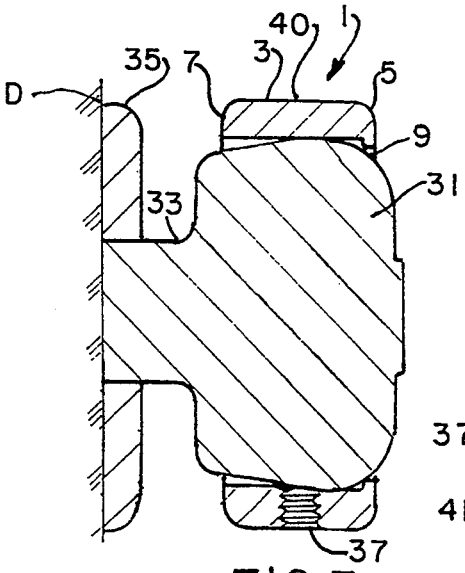
FIG. 3 is a cross-sectional view taken along line 3—3 of FIG. 2.
Figure 4:
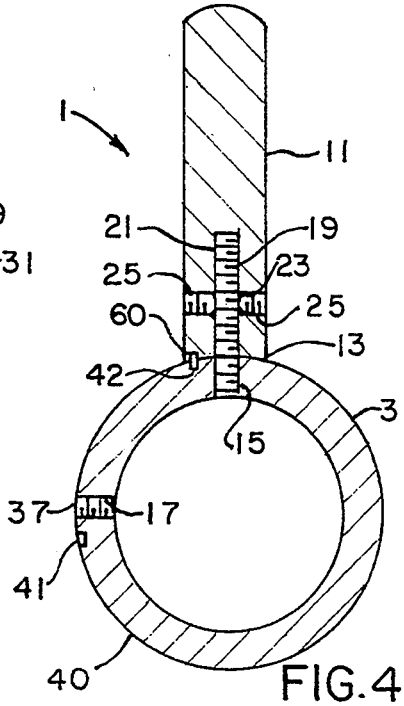
FIG. 4 is a cross-sectional view of the attachment.

Body 3 is sized to slidably fit over a door knob 31. Door knob 31 is a standard door knob such as is found in office and commercial locations, for example. Knob 31 is secured to an axle 33 which extends through a door D as is known. The hole which is formed in the door is covered by a plate 35. When body 3 is placed over knob 31, flange 9 comes into contact with the knob, as shown in FIG. 3, to prevent the attachment 1 from sliding completely over knob 31. Flange 9 thus acts as a stop. A set screw 37 is received in body hole 17 and is screwed in until it contacts the side of knob 31. Screw 37 is not screwed into knob 31 and thus avoids the need to modify knob 31 to secure the attachment 1 thereto. The inner diameter of body 3 is only marginally larger than knob 31 so that it may be easily placed over knob 31. This will facilitate easy application of the attachment to the knob and avoid the need to remove knob 31 from the door to secure attachment 1 in place. Set screw 37 frictionally, rotationally fixes attachment 1 with respect to knob 31. Thus, when the arm 11 is pushed downward, as shown with reference to FIG. 2, the knob will be rotated to open the door D.

The use of set screw 37 and flange 9 facilitates the application of attachment 1 to nearly all styles of door knobs which are circular in cross-section. The construction provides for non-handed installation of the attachment 1. As indicated above, doors and their respective knobs can be installed in either left or right hand locations. While a right hand location is shown in FIG. 1, left hand operation is accomplished easily. Because post 19 is removably mounted in opening 15, while screw is removably mounted in opening 17, the respective mounting location of the posts merely are reversed with respect to one another, and with proper rotation of the body 3, left handed operation of the attachment 1 is accomplished.

In order to provide additional stability or proper "feel" to the attachment 1 operation, the preferred embodiment of my invention also has a guide pin 60 mounted along the front 3 of arm 11. Corresponding bores 42 and 41 are positioned properly with respect to the opening 15 and 17 in the body 3 bores to receive the pin 60 in the mounted location of the arm 4.

Numerous variations, within the scope of the appended claims, will be apparent to those skilled in the art in light of the foregoing description and accompanying drawings. For example, rather than having a body which is a full annulus, a generally C-shaped body could be used which has a flexible, adjustable strap. The strap could be tightened, as with a hose clamp type system, to fix the attachment to the door knob. The location, size and position of posts may be varied, if desired. Likewise, the physical design of the attachment 1 may be varied in other embodiments of this invention. These variations are merely illustrative.

Having thus described the invention, what is claimed and desired to be secured by Letters Patent is:

1. A door handle comprising:

a body having a front, a back, and at least one side wall, said body having an axial opening extending therethrough and sized to receive the door handle, said body having a flange extending radially inwardly from the body along the front thereof, said side wall having a pair of side wall openings formed in it communicating with said axial opening, said side wall openings being spaced from one another, and a pair of bore openings predeterminingly located with respect to respective ones of said side wall openings;

a lever removably mounted to said body, said lever including a front, an opening extending inwardly from said front, and at least one opening communicating with the opening with said front and positioned angularly with respect thereto, and a guide pin extending from said front;

a post mounted in one of said openings in said body and so as to extend therefrom and to be received in the opening in the front of said lever;

means for attaching said lever to said post; and means for attaching said body to said door handle including said guide pin, the guide pin of said lever being insertable in the bore opening of said body in the mounted position of said lever.

2. The attachment of claim 1 wherein said front of said lever is designed to intermount with the side wall of said body.

* * * * *